US008561692B1

(12) United States Patent
Schultz et al.

(10) Patent No.: US 8,561,692 B1
(45) Date of Patent: Oct. 22, 2013

(54) DOWNHOLE SAFETY JOINT

(71) Applicants: Roger L. Schultz, Ninnekah, OK (US); Brock Watson, Oklahoma City, OK (US)

(72) Inventors: Roger L. Schultz, Ninnekah, OK (US); Brock Watson, Oklahoma City, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 0 days.

(21) Appl. No.: 13/749,463

(22) Filed: Jan. 24, 2013

Related U.S. Application Data

(63) Continuation of application No. 13/488,348, filed on Jun. 4, 2012.

(51) Int. Cl.
*E21B 17/00* (2006.01)

(52) U.S. Cl.
USPC ..... 166/242.6; 175/325.2; 285/922; 285/333; 285/92

(58) Field of Classification Search
USPC ..... 166/242.6; 175/325.2; 285/2, 4, 81, 9, 285/333, 383; 411/285, 929; 464/18, 140, 464/45, 183, 902
See application file for complete search history.

(56) References Cited

U.S. PATENT DOCUMENTS 3,067,593 A * 12/1962 McCool ..... 464/183

* cited by examiner

*Primary Examiner* — Yong-Suk (Philip) Ro
(74) *Attorney, Agent, or Firm* — Belair Intellectual Property Law LLC

(57) ABSTRACT

A downhole safety joint for use in a wellbore is described. The downhole safety joint includes an upper tubular member having an upper threaded end and a lower external threaded section; a lower tubular member having a lower threaded end and an upper interior threaded section for engaging with the lower external threaded section to form a break joint, the break joint having one or more of a maximum compressive stress limit and a tensile stress limit; and one or more circumferential stress reliefs disposed into the outer diameter of at least one of the upper tubular member and the lower tubular member for transmitting a side load applied to the break joint to one or more of the circumferential stress reliefs less than one or more of the compressive stress limit and the tensile stress limit.

14 Claims, 5 Drawing Sheets

DOWNHOLE SAFETY JOINT

CROSS-REFERENCE TO RELATED APPLICATIONS

This application is a continuation of prior U.S. patent application Ser. No. 13/488,348, filed Jun. 4, 2012. The entirety of this aforementioned application is incorporated herein by reference.

TECHNICAL FIELD OF THE INVENTION

This invention relates, in general, to a safety joint used in a wellbore and, in particular, to a downhole safety joint used with a work string in a wellbore that traverses a subterranean hydrocarbon bearing formation.

BACKGROUND OF THE INVENTION

Without limiting the scope of the present invention, its background will be described in relation to a downhole safety joint, as an example.

There are many different operations involved in drilling and completing an oil and/or gas well; some of these operation include drilling, surveying, and completing a well. Oftentimes, these wells are drilled at extreme depths and many times they are drilled directionally such that one or more bends exist in the wellbore that can cause a pipe string, drillstring, tool string, service string, and the like ("work string") to become stuck deep in the wellbore. Many times expensive tools, instruments, and the like are located towards the lower end of these work strings. Thus, once stuck, it oftentimes is desirable to retrieve as much of this equipment and instruments as possible.

One method for recovering this equipment involves running a string shot on a wireline down as far as possible through the inner diameter of the stuck work string and firing an explosive to separate the joint where it can be backed off. Typically, this process includes putting left hand torque on the work string, applying substantially neutral weight to the desired joint proximal to the string shot, and then firing the string shot, which causes the joint to break enabling the recovery of the work string and any equipment and instruments above the joint to be recovered. One of the problems associated with this procedure is that many times the work string may include equipment, tools, instruments, and their related components disposed in the inner diameter thus blocking the downward passage of the string shot and wire line past that point that would prevent locating and firing the string shot below that point. Any expensive equipment and instruments located below that point would not be able to be retrieved typically using this method.

Another retrieval method is to include what is known as a "safety joint" in the work string. A safety joint is typically a tubular member consisting of an upper and lower sub that are disconnectable from each by a variety of known means. In one such means, coarse threads join the upper and lower sub, such that when a string becomes stuck in a wellbore, left hand torque may be applied to the work string which then uncouples (unscrews) the upper sub from the lower sub, thus enabling the upper sub and the work string above it to be retrieved leaving the lower sub and parts of the work string below it in the wellbore. Typically, the torque required to unscrew the safety joint is a fraction of the torque required to break the threaded connections between the joints of the work string, which the safety joint is connected, thus unscrewing the safety joint but not any other tubular members of the work string. Sometimes, these safety joints are placed lower in the work string than expensive equipment and instruments, thus ensuring that the equipment and instruments may be retrieved once the safety joint has been disconnected.

Also, once retrieved at the surface and the expensive equipment and instruments have been recovered, the upper sub may be re-coupled to a work string having a substantially open inner diameter, and run back into the wellbore for reconnecting with the lower sub. Doing so then provides a substantially open inner diameter all the way to the bottom hole assembly ("BHA") at or near the bottom of the wellbore or distal end of the stuck work string. This method may then include running a string shot in and shooting it off to recover more of the stuck work string via a wireline or other known means. In another method, a jar may be attached upstring of the retrieved upper sub and run back into the wellbore for reconnecting with the lower sub of the safety joint and jarring the stuck work string.

One problem associated with these types of safety joints is that the threaded sections of the subs making up a break joint may include seals disposed about the ends of the threaded sections that may trap fluids or mud within the safety joint when the upper sub is being reconnected with the lower sub in the wellbore. The trapped mud or fluid located within the upper and lower subs is under extreme pressure and may cause the subs to become hydraulically locked. Drilling mud is often designed to fill and plug voids to prevent fluid loss into the formations being penetrated by the wellbore. This characteristic can cause difficulty in making up a safety joint downhole because the mud tends to plug off and seal inside the threads as they are screwed back together. This can further add to the problem of hydraulic locking in the safety joint because the fluid is trapped inside the threaded connection and cannot be exhausted through the safety joint.

When hydraulically locked, operators may apply more torque in response to the hydraulic lock in an attempt to reach a proper seat of the upper and lower sub, which may damage the safety joint, subs, and/or other equipment in the wellbore.

Another problem associated with hydraulically locked subs is that when torque is backed off due to the operator's belief that the threaded ends of the subs are properly engaged, it will in fact mean that the safety joint is not properly made up and may become disconnected when it is retrieved from the wellbore, thus causing tubular members, equipment, instruments, and the like to be dropped into the wellbore.

Additionally, conventional safety joints are oftentimes run into wellbores having highly deviated, horizontal, or tortuous trajectories to access substantially horizontal hydrocarbon bearing formations. Under these situations, the safety joint experiences a tensile load (e.g., pulling work string out of wellbore) or a compressive load (e.g., adding weight to the work string) in the axial direction of the safety joint while in the wellbore. In addition, the safety joint will experience a bending or side load when it is in these situations or environments. These bending loads are caused by the distal ends of the safety joint being in contact with a sidewall of the wellbore, casing, liner, etc., while concurrently the substantially opposite side of the safety joint's central section or break joint encounters a substantially opposite linear side load. The side load creates a compressive stress on one side of the break joint and a tensile stress on the opposite side of the break joint.

Further, the stress caused by the axial loading will add to or subtract from the stress caused by the bending load. If there is a large enough positive or negative axial load, the safety joint will remain completely or constantly in tensile or compressive stress throughout the safety joint, but the sides or top/bottom (substantially horizontal orientation) of the safety joint will experience different stress levels due to the bending load or stress. It is this cyclical variation in stress state caused by the cyclic bending loads that causes break joints to tighten, loosen, cause total failure of the break joint. Also, the shoulders of the break joint may become damaged by the cyclical loading causing the break joint to become looser than required, thus causing unreliable break joint connections that are difficult to reliably make up or break under desired torque ratings.

SUMMARY OF THE INVENTION

The present invention disclosed herein is directed to a downhole safety joint that provides reduced wear to break joints of safety joints while running into highly deviated wellbores, improved coupling efficiency, and reduced chances of hydraulic lock when reconnecting safety joint. It further provides for improved fluid flow within the downhole safety joint during make up so as to avoid hydraulic locking.

In one embodiment the present invention may be directed to a downhole safety joint for use in a wellbore, including an upper tubular member having an upper threaded end and a lower external threaded section; a lower tubular member having a lower threaded end and an upper interior threaded section for engaging with the lower external threaded section to form a break joint, the break joint having one or more of a maximum compressive stress limit and a tensile stress limit; and one or more circumferential stress reliefs disposed into the outer diameter of at least one of the upper tubular member and the lower tubular member for transmitting a side load applied to the break joint to one or more of the circumferential stress reliefs less than one or more of the compressive stress limit and the tensile stress limit.

In one aspect, the one or more circumferential stress reliefs may be circumferential recessed areas in the outer diameter of the one of the upper tubular member and the lower tubular member. In another aspect, the one or more circumferential stress reliefs may be a circumferential recessed area disposed between the upper threaded end and the lower external threaded section of the upper tubular member. I yet another aspect, one or more circumferential stress reliefs may be a circumferential recessed area disposed between the lower threaded end and the upper internal threaded section of the upper tubular member.

In still yet another aspect, the one or more circumferential stress reliefs may have an outer diameter less than at least one of the upper tubular member and the lower tubular member. Preferably, the one or more circumferential stress reliefs may flex or bend to transmit the side load exceeding one or more of the maximum compressive stress limit and tensile stress limit to the one or more circumferential stress reliefs. Also preferably, the one or more circumferential stress reliefs may flex or bend to transmit 90 percent of the side load exceeding one or more of the maximum compressive stress limit and tensile stress limit to the one or more circumferential stress reliefs.

In another embodiment, the present invention is directed to a downhole safety joint for use in a wellbore, including an upper sub having an upper threaded end and a lower end having a plurality of external threads; a lower sub having a lower threaded end and an upper end having a plurality of internal threads for engaging with the plurality of external threads to form a break joint; and a channel formed by gaps between the plurality of external and internal threads for transmitting a fluid therebetween when engaging the upper sub to the lower sub.

In one aspect, the gaps may be formed by the plurality of external threads have a width less than the width of the corresponding plurality of internal threads. In another aspect, the gaps may be formed by the plurality of internal threads have a width less than the width of the corresponding plurality of external threads. In yet another aspect, the channel may extend along all of the plurality of external threads and internal threads.

Preferably, the gaps may be from about 0.10 inches to about 0.02 inches. Also preferably, the gaps may be from about 0.08 inch to about 0.03 inch. In another aspect, the gaps may be from about 0.06 inch to about 0.04 inch.

In yet another embodiment, the present invention is directed to a downhole safety joint for use in a wellbore, including an upper sub having an upper threaded end and a lower section having a plurality of external threads, the lower section having a non-threaded section below the lower threaded section; a lower sub having a lower threaded end and an upper end having a plurality of internal threads for engaging with the plurality of external threads to form a break joint; and a longitudinal slot disposed in the outer diameter of the non-threaded section to provide a fluid pathway to a central passageway of the downhole safety joint.

In one aspect, the longitudinal slot may be a groove formed into the non-threaded section. In another aspect, the downhole safety joint may further include a seal disposed about the non-threaded section, wherein the longitudinal slot is disposed below the seal in the non-threaded section. In still another aspect, the non-threaded section may terminate in a tapered end.

In still yet another embodiment, the present invention may be directed to a downhole safety joint for use in a wellbore, including an upper tubular member having an upper threaded end and a lower section having a plurality of external threads, the lower section having a non-threaded section below the lower threaded section; a lower tubular member having a lower threaded end and an upper end having a plurality of internal threads for engaging with the plurality of external threads to form a break joint, the break joint having one or more of a maximum compressive stress limit and a tensile stress limit; one or more circumferential stress reliefs disposed into the outer diameter of at least one of the upper tubular member and lower tubular member for transmitting a side load applied to the break joint to one or more of the circumferential stress reliefs less than one or more of the compressive stress limit and the tensile stress limit; a channel formed by gaps between the plurality of external and internal threads for transmitting a fluid therebetween when engaging the upper tubular member with the lower tubular member; and a longitudinal groove disposed in the outer diameter of the non-threaded section to provide a fluid pathway to a central passageway of the downhole safety joint.

In one aspect, the one or more circumferential stress reliefs may have circumferential recessed areas in the outer diameter of the one of the upper tubular member and the lower tubular member. In another aspect, the one or more circumferential stress reliefs may be a circumferential recessed area disposed between the upper threaded end and the lower external threaded section of the upper tubular member. In yet another aspect, the one or more circumferential stress reliefs may be a circumferential recessed area disposed between the lower threaded end and the upper internal threaded section of the upper tubular member. In still yet another aspect, the one or more circumferential stress reliefs may have an outer diameter less than at least one of the upper tubular member and the lower tubular member.

Preferably, the gaps may be formed by the plurality of internal threads have a width less than the width of the corresponding plurality of external threads. Also preferably, the one or more circumferential stress reliefs may flex to transmit less than the maximum tensile stress limit of the applied tensile stress to the break joint. Additionally, the gaps may be from about 0.06 inch to about 0.04 inch. Also, the one or more circumferential stress reliefs may flex or bend to transmit the side load exceeding one or more of the maximum compressive stress limit and tensile stress limit to the one or more circumferential stress reliefs. Further, the one or more circumferential stress reliefs may flex or bend to transmit 90 percent of the side load exceeding one or more of the maximum compressive stress limit and tensile stress limit to the one or more circumferential stress reliefs.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

In the following description of the representative embodiments of the invention, directional terms, such as "above," "below," "upper," "lower," etc., are used for convenience in referring to the accompanying drawings. In general, "above", "upper", "upward," and similar terms refer to a direction toward the earth's surface along a wellbore, and "below," "lower," "downward," and similar terms refer to a direction away from the earth's surface along the wellbore. Additionally, the term "proximal" refers to a linear, non-linear, or curvilinear distance or point nearer to a point of reference or direction that is closer to a relative term or object, and the term "distal" refers to a linear, non-linear, or curvilinear distance or point farther to a point of reference or direction that is farther to a relative term or object.

Figure 1A:
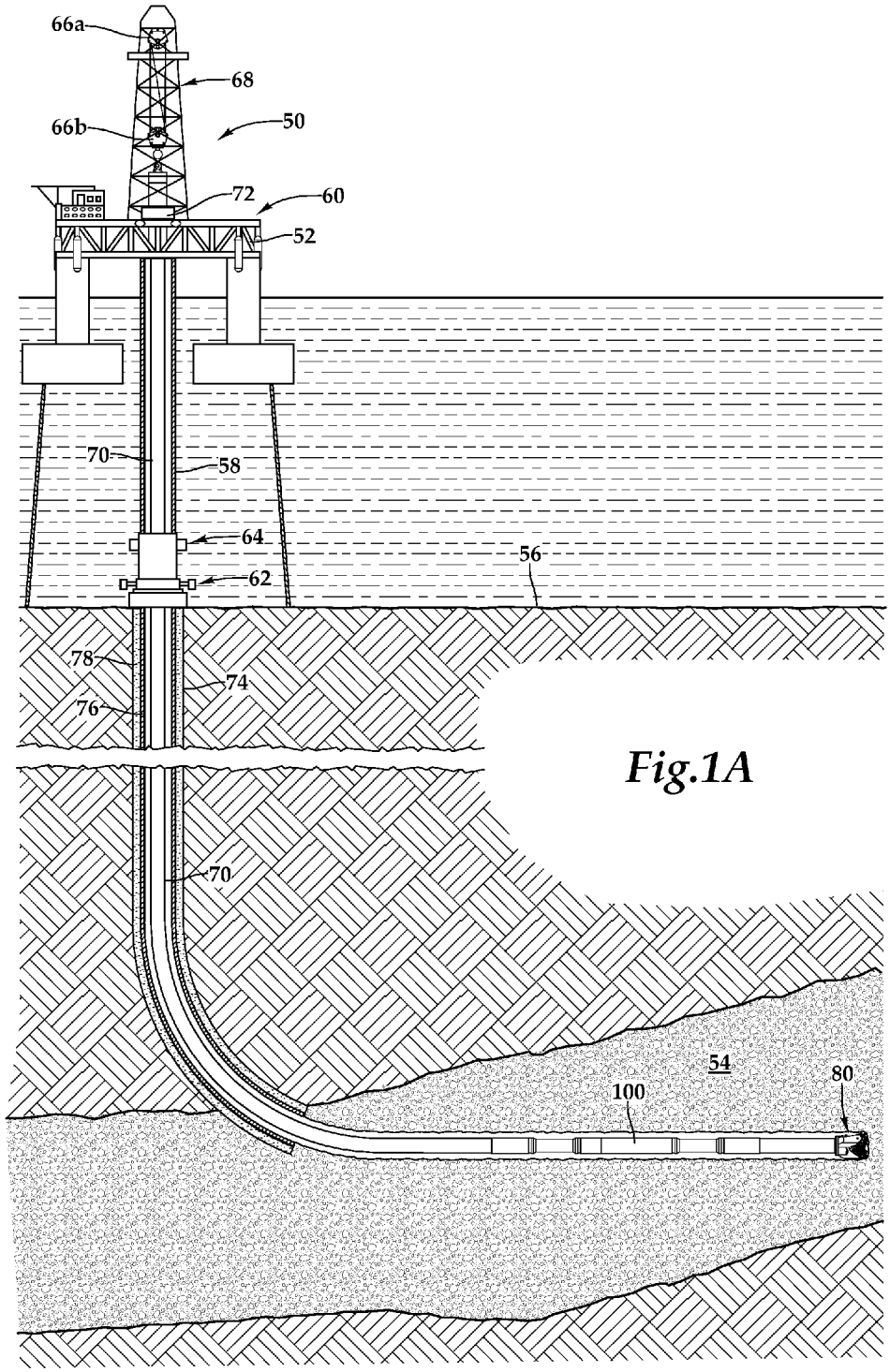
FIG. 1A is a schematic illustration of an offshore platform in operable communication with a downhole safety joint in a connected work string according to an embodiment.
Figure 1B:
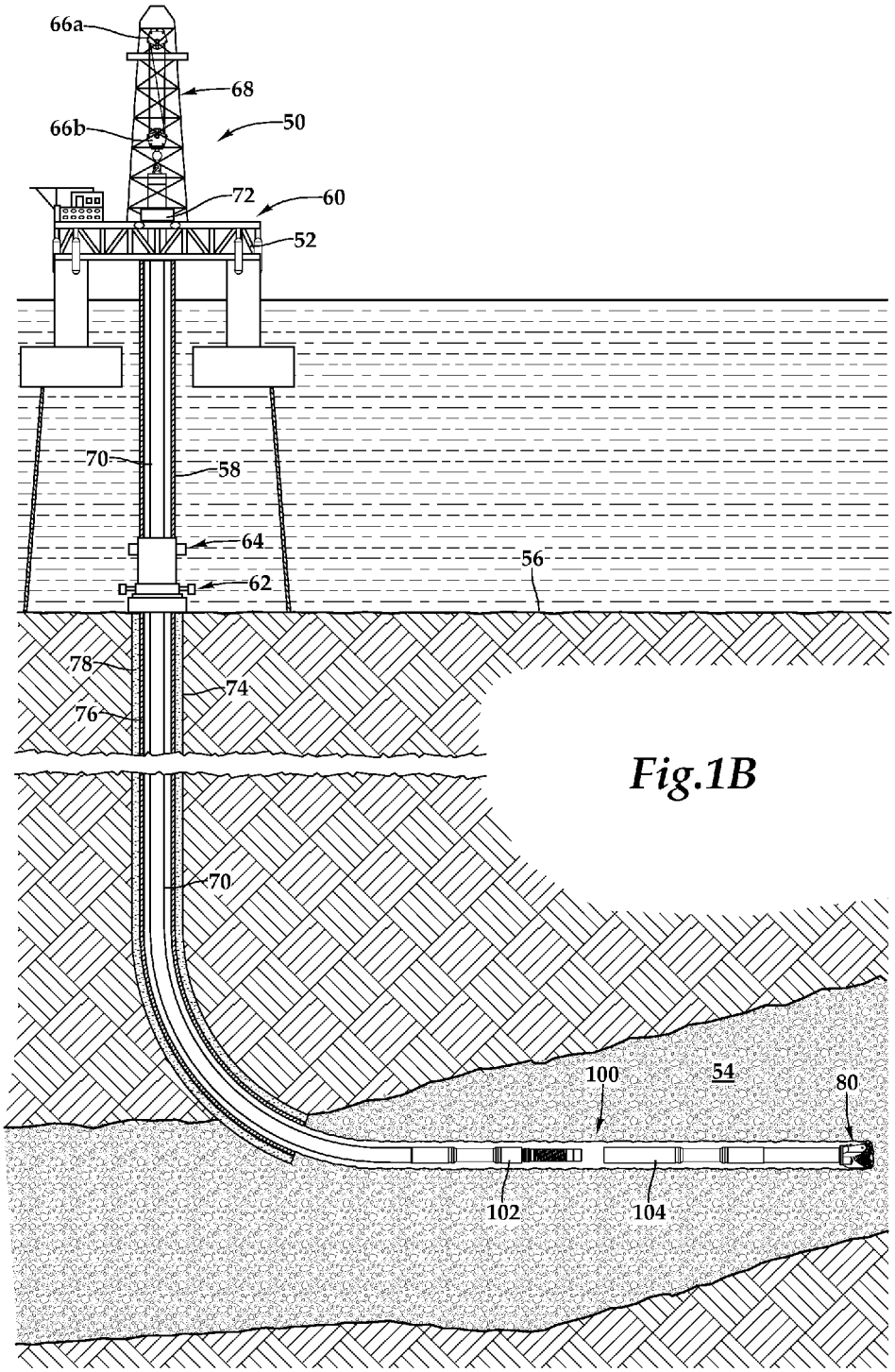
FIG. 1B is a schematic illustration of an offshore platform in operable communication with a downhole safety joint in a disconnected work string after operation of the downhole safety joint according to an embodiment.

Referring to FIGS. 1A and 1B, a downhole safety joint 100 in use with an offshore oil and gas drilling or production platform is schematically illustrated and generally designated 50. A semi-submersible platform 52 is located over a submerged oil and gas formation 54 located below sea floor 56. Although downhole safety joint 100 is discussed herein with reference to oil and gas drilling or production platform 50, downhole safety joint 100 may be used with any type of onshore or offshore oil and/or gas rig as are commonly known to those skilled in the art. A subsea conduit or marine riser 58 extends from deck 60 of platform 52 to a wellhead 62 that may include a blowout preventer 64 disposed above wellhead 62, in one embodiment.

Disposed above blowout preventer 64 may be a flexible or ball joint (not shown) for providing a flexible sealing connection between marine riser 58 and blowout preventer 64, in one embodiment. Platform 52 may have a hoisting apparatus 68*a*-68*c* (collectively hoisting apparatus 68), a derrick 68 for raising and lowering a work string 70, and a rotary table 72 for rotating work string 70, in one embodiment. A wellbore 74 extends through the various earth strata including oil and gas formation 54. A casing 76 may be cemented within a substantially vertical section of wellbore 76 by cement 78, in one embodiment.

Casing 76 and cement 78 are shown disposed about work string 70 to a particular depth of wellbore 74; however, casing 76 and cement 78 may extend to any desirable depth of wellbore 74. Further, in this specification, the term "casing" may also mean "liner" and may be used interchangeably to describe tubular materials, which are used to form protective casings and the like in wellbore 74. Casing 76 may be made from any material such as metals, plastics, composites, or the like, and may be expanded or unexpanded as part of an installation procedure, and may be segmented or continuous. Also, it is not necessary for casing 76 and/or line to be cemented in wellbore 74. Any type of casing 76 or liner may be used in keeping with the principles of downhole safety joint 100. Additionally, wellbore 74 may be lined by any other casing types, liners, and the like as are commonly known to those skilled in the art. Casing 76 may include additional tubular members disposed below wellhead 62 having different diameters as is commonly known to those skilled in the arts. Additionally, work string 70 may include a bottom hole assembly ("BHA") 80. Generally, BHA 80 may be a bit, bit sub, mud motor, stabilizers, drill collars, drillpipe, jars, crossovers, instruments, equipment, and the like.

Although FIGS. 1A-1B depict downhole safety joint 100 in a substantially horizontal portion of wellbore 76, it should be understood by those skilled in the art that downhole safety joint 100 may be equally well suited for use in wells having other directional configurations including horizontal wells, deviated wellbores, slanted wells, multilateral well, and the like.

FIG. 1A depicts downhole safety joint 100 in a coupled or connected to work string 70. The location of downhole safety joint 100 in work string 70 may have any types of instruments, tubulars, equipment and the like located above or below downhole safety joint 100 in work string 70. In one aspect, downhole safety joint 100 may be placed below in work string 70 of instruments, tubulars, equipment and the like that may be desired to be retrieved should the part of work string 70 below downhole safety joint 100, such as BHA 80 become stuck in wellbore 74. As shown in FIG. 1A, downhole safety joint 100 is in its connected state in work string 70.

Figure 2A:
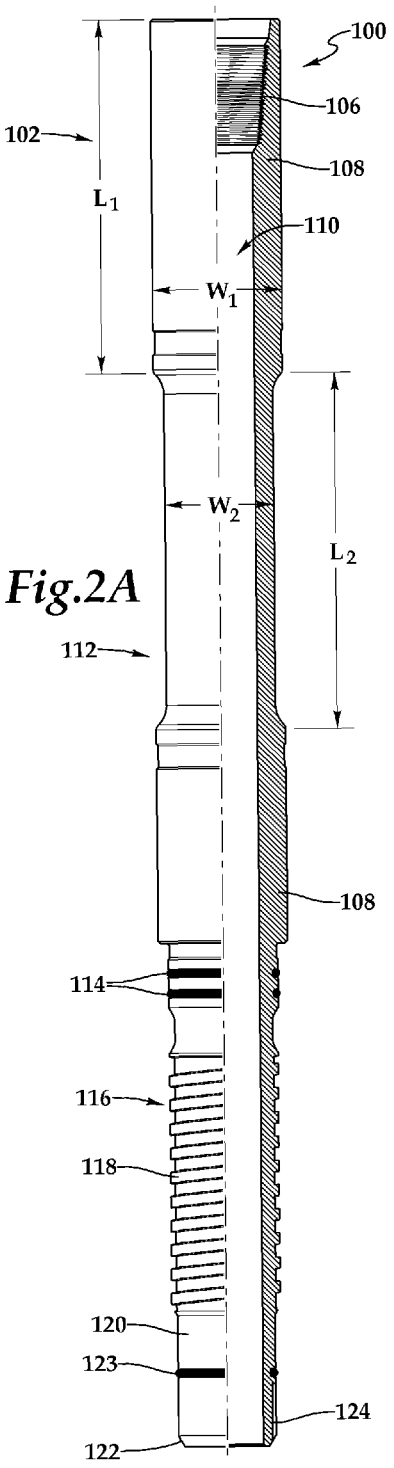
FIGS. 2A-2B are quarter-sectional views of a disconnected upper sub and lower sub of downhole safety joint according to an embodiment.

FIG. 1B depicts downhole safety joint 100 in a uncoupled or disconnected operation. In FIG. 1B, downhole safety joint 100 has been operated and an upper sub 102 (FIG. 2A) of downhole safety joint 100 has been disconnected from a lower sub 104 (FIG. 2B) of downhole safety joint 100 have been disconnected with each other separated by a distance. Upper sub 102 is shown connected with the upper part of work string 70 while lower sub 104 is shown connected with the lower end of work string 70, including BHA 80.

Referring now to FIG. 2, upper sub 102 of downhole safety joint 100 is shown. Upper sub 102 includes a substantially tubular axially threaded end or connector 106 that is operable for coupling to a lower end of a tubular member of work string 70 located above upper sub 102. Upper sub 102 further includes a tubular body 108 that defines an inner central passageway 110 that extends through upper sub 102 and allows the passage of fluids therethrough. An upper section of tubular body 108 of has an outer diameter ($W_1$) extending a length ($L_1$) from the upper end of threaded connector 106 to substantially the beginning of a circumferential stress relief section 112. Stress relief section 112 further extends a length ($L_2$) that extends from the end of length ($L_1$). Preferably, the outer diameter of stress relief section 112 has a reduced width ($W_2$) than that of the width ($W_1$) of the outer diameter of tubular body 108.

Extending from the lower section of stress relief section 112 is tubular body 108 having an outer diameter substantially similar to outer diameter ($W_1$). Also, upper sub 102 includes a male or pin end 116 that includes a plurality of coarse right-handed exterior threads 118. Upper sub 102 may also include one or more seals 114 for providing sealing relationship between pin end 116 of upper sub 102 and box end 130 of lower sub 104 when the two are engaged as described further below. Upper sub 102 may further include a non-threaded section 120 below threads 118 that may have a seal 123 disposed about it for providing a sealing relationship with box end 130 of lower sub 104. Additionally, upper sub 102 may include a nose or tapered end 122 for assisting engaging pin end 116 in engaging box end 130 when downhole safety joint 100 is being recoupled or reconnected in wellbore 74.

Upper sub 102 further includes one or more longitudinal recesses, slots, or grooves 124 that are disposed into non-threaded section 120 below seal 123 and that extend longitudinally to tapered end 122 for providing a release channel for fluid trapped between tapered end 122 and seal 123 and the interior of box end 130 when upper sub 102 is being recoupled or reconnected with box end 130 of lower sub 104 as further described below with reference to FIG. 4.

Figure 3A:
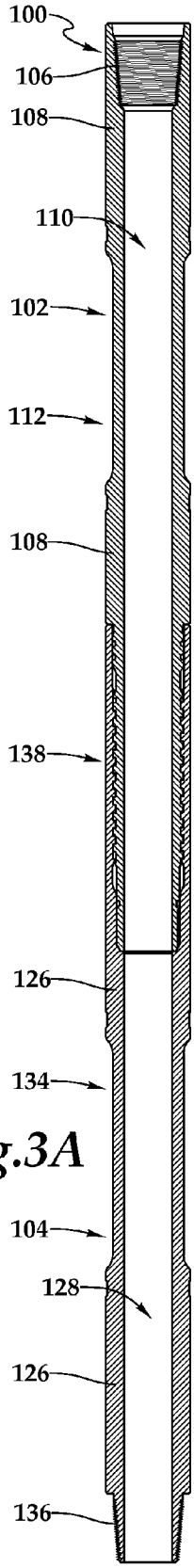
FIG. 3A is a cross-sectional view of a downhole safety joint of FIGS. 2A-2B according to an embodiment.

Lower sub 104 includes a tubular body 126 that may have an outer diameter that is substantially similar to the section of tubular body 108 above seal 114 such that when upper sub 102 and lower sub 104 are fully connected, tubular body 126 forms a consistent outer diameter with tubular body 108, in one example. Lower sub 104 includes an inner central passageway 128 that extends through lower sub 104 and allows the passage of fluids therethrough. When upper sub 102 and lower sub 104 are coupled together, passageway 110 and passageway 128 form a common central passageway for allowing fluids to pass through the entire length of downhole safety joint 100 as best shown in FIG. 3A. Box end 130 includes a plurality of coarse right-handed interior threads 132 for matingly engaging with threads 118 of pin end 116.

As discussed above, seals 114, 123 provide a sealed section or compartment for threads 118 and threads 132 when pin end 116 is fully engaged with box end 130. This sealing arrangement prevents fluids from entering the space between seals 114 and seal 123 when downhole safety joint 100 is run into wellbore 74. This sealing arrangement keeps threads 118 and threads 132 substantially free from fluids that may be present during the running in of downhole safety joint 100 that may deteriorate threads 118 and threads 132 if present for a prolonged period.

Figure 2B:
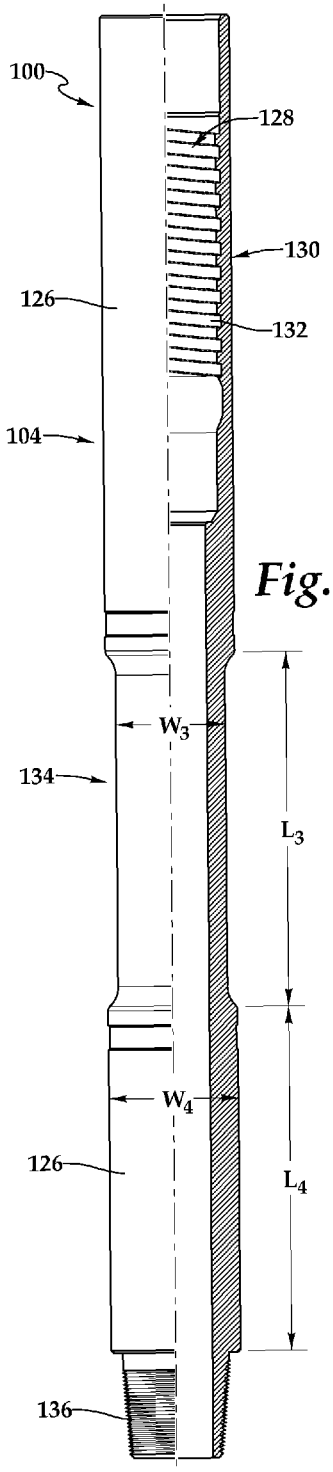

Lower sub 104 may further include a circumferential stress relief section 134 that may begin at the lower portion of the upper section of tubular body 126 and extend a length ($L_3$) to the upper portion of the lower section of tubular body 126 as shown in FIG. 2B. Stress relief section 134 has an outer diameter having an outer diameter having a width ($W_3$). Preferably, width ($W_3$) of outer diameter of stress relief section 134 is less than the width ($W_4$) of the outer diameter of tubular body 126 as shown in FIG. 2B. In generally, lower sub 104 may have a section of tubular body 126 that extends a length ($L_4$) below stress relief section 134. Lower sub 104 also includes a substantially tubular axially threaded end or connector 136 that is operable for coupling to an upper end of a tubular member of work string 70 located below lower sub 104.

Figure 3B:
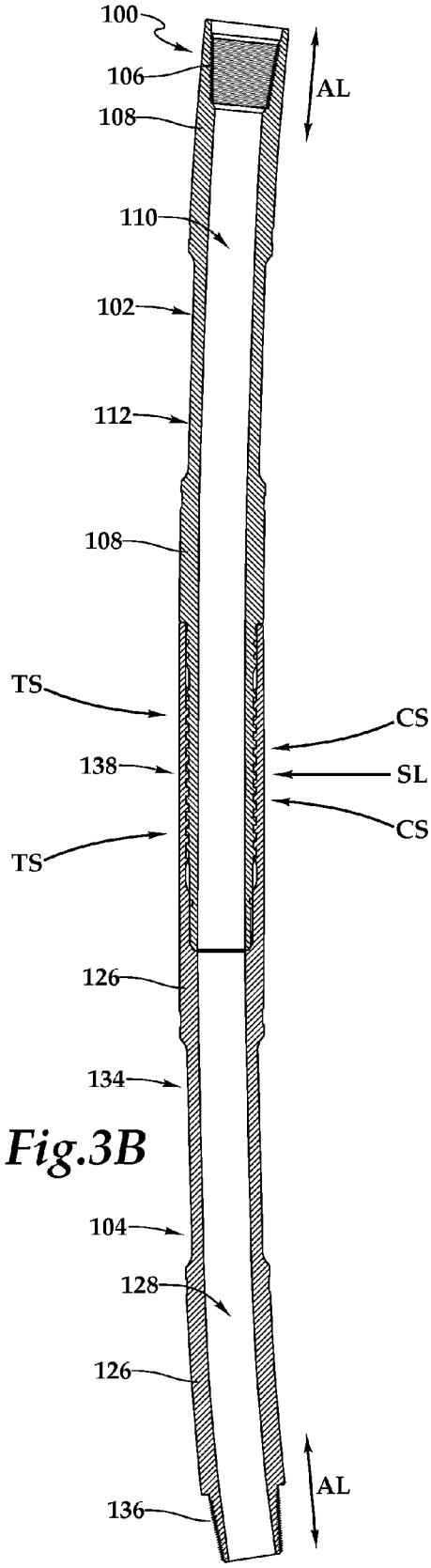
FIG. 3B is a cross-sectional view of a downhole safety joint of FIGS. 2A-2B under a bending load according to an embodiment.

Now turning to FIGS. 3A-3B, a completely coupled downhole safety joint 100 is shown where upper sub 102 and lower sub 104 have been coupled together at a break joint 138 consisting of pin end 116 fully engaged with box end 130. In one aspect, break joint 138 has a maximum tensile stress limit such that exceeding the limit will cause damage to one or more of pin end 116, threads 118, box end 130, and threads 132. The maximum tensile stress limit is dependent upon the engineered dimensions and materials of these elements and would be commonly known to those skilled in the arts.

As shown, tubular body 126 and tubular body 108 may have a substantially similar outer diameter such that they provide a substantially uniform outer diameter. In one embodiment, downhole safety joint 100 may include just stress relief section 112 and not stress relief section 134. In another embodiment, downhole safety joint 100 may include stress relief section 134 and not stress relief section 112. In yet another embodiment, downhole safety joint 100 may include both stress relief section 112 and stress relief section 134.

In one embodiment, width ($W_2$), length ($L_2$), width ($W_3$), and length ($L_3$) of stress relief sections 112, 134, respectively, are of dimensions such that they reduce the tensile loading or stress exerted on break joint 138 while running downhole safety joint 100 in and out of wellbore 74. Stress relief sections 112, 134 allow downhole safety joint 100 to bend or flex at the upper and lower ends of downhole safety joint 100 under bending or tensile loading such as when operated in deviated, horizontal, or tortuous trajectories or wellbores.

Stress relief sections 112, 134 reduce the excessive stress and strain on break joint 138, thus reducing the likelihood of failure of break joint 138. Stress relief sections 112, 134 protect the threads 118 and threads 132 of break joint 138 from being "worked" by the bending stress experienced on downhole safety joint 100 in work string 70 as it is being run in and out of deviated wellbores. When downhole safety joint 100 is forced into a forced deflection or stress such as when running in and out of a deviated wellbore, stress relief sections 112, 134 balance the stress encountered by downhole safety joint 100 such that they flex an amount substantially equal to the amount of stress that would cause the weakest component of break joint 138 of downhole safety joint 100 to fail or become damaged over period of usage.

As shown in FIG. 3B, downhole safety joint 100 is shown experiencing a side load ("SL") caused by a highly deviated, horizontal, or tortuous trajectory in wellbore 74 to access substantially horizontal hydrocarbon bearing formations, in one example. SL causes a compressive stress ("CS") on one side, top, or bottom of downhole safety joint 100 and a tensile stress ("TS") on the other side, bottom, or top of downhole safety joint 100. The flex or bend shown at the distal ends of downhole safety joint 100 is caused by connector 106 and connector 136 being disposed against a substantially opposing side of wellbore 74 than that exerted by SL at or near break joint 138. Due to stress relief sections 112, 134, downhole safety joint 100 bends or flexes more at, near, or towards their distal ends, connector 106 and connector 136, than at break joint 138, thus decreasing the cyclical loading at break joint 138 at described herein caused by fully or in part the axial loading ("AL") along the longitudal axis of downhole safety joint 100 caused by weighting/unweighting work string 70 during operation of work string 70 and downhole safety joint 100.

Because of the reduced outer diameter of stress relief sections 112, 134, downhole safety joint 100 flexes or bends more readily at the end sections of downhole safety joint 100. This preferable flexing or bending may preferably occur along the section of downhole safety joint 100 from connector 106 to the lower sections of stress relief section 112, in one embodiment. Additionally, this preferable flexing or bending may preferably occur along the section of downhole safety joint 100 from connector 136 to the upper section of stress relief section 134, in one embodiment. While providing such flexing/bending sections of downhole safety joint 100 alleviates the CS and TS on break joint 138 thus preventing undesirable loosening and/or tightening of break joint 138.

Figure 4:
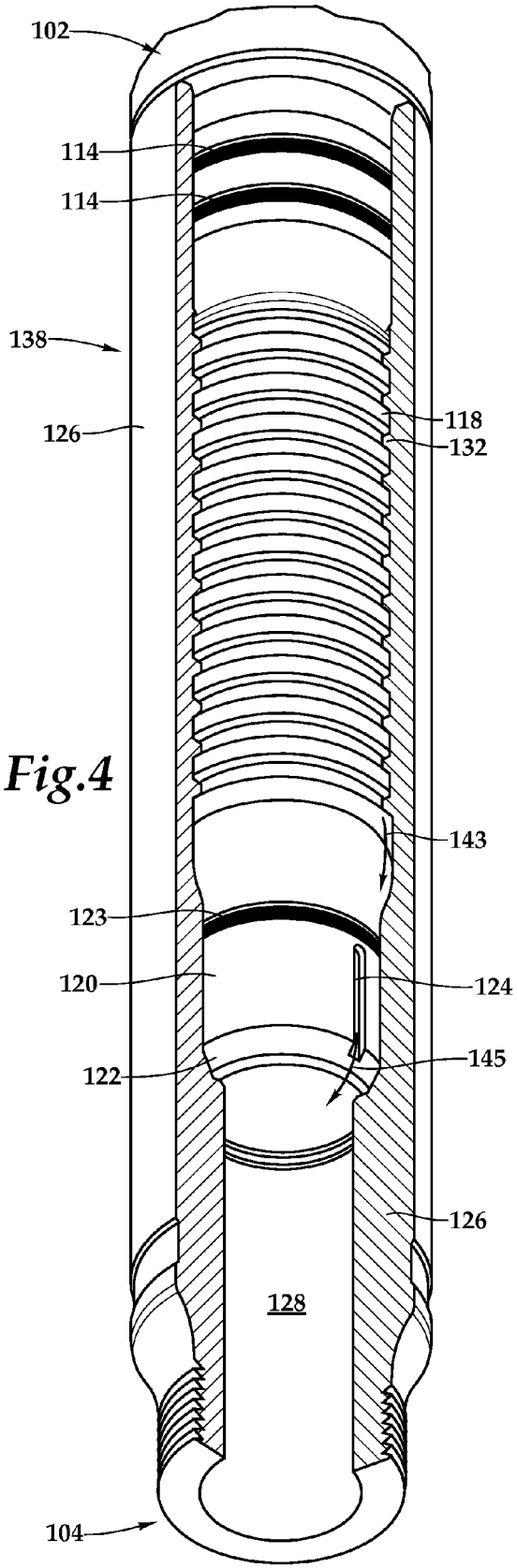
FIG. 4 is a partial quarter-sectional perspective view of a downhole safety joint of FIG. 3A according to an embodiment.
Figure 5:
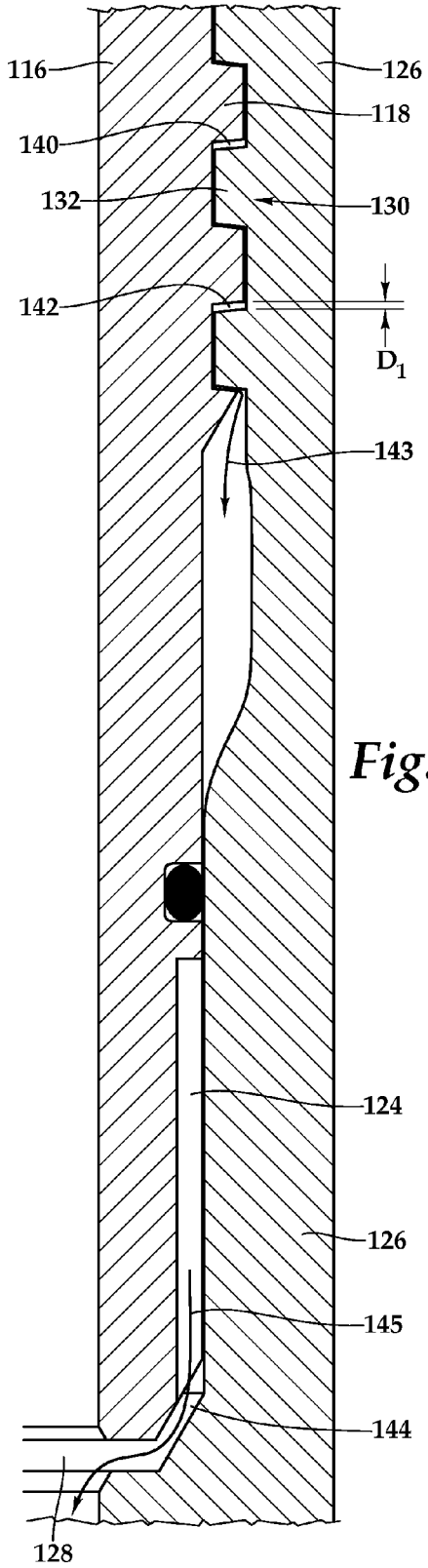
FIG. 5 is an enlarged view of a portion of a threaded section of a break joint of the downhole safety joint of FIG. 3A according to an embodiment.

Turning now to FIGS. 4-5, upper sub 102 and lower sub 104 are shown substantially coupled together. Downhole safety joint 100 has two different sealing areas and/or diameters that relieve and/or release fluid as upper sub 102 is coupled together with lower sub 104 in the presence of fluid under pressure. A first sealing diameter exists substantially between seals 114 and the portion of box end 130 above seal 123. As upper sub 102 and lower sub 104 are coupled or screwed together fluid under pressure in this first sealing diameter or area flow through a channel created by gaps 140, 142 of all of threads 118 and threads 132, as best shown in FIG. 5, and flows via flow channel 143 created by the gap, similar to gaps 140, 142, between the bottom set of threads. In one embodiment, threads 118 may have a width or pitch less than standard width relative to the width or pitch of threads 132. In another embodiment, threads 132 may have a width or pitch less than standard relative to the width or pitch of threads 118.

Most if not all of fluid flowing in flow direction 143 flow over seal 123 before it enters the space of the second sealing area created between the diameter or area between tapered end 122 and the sealing engagement of seal 123 and the inner surface of tubular body 126. Fluid in this space then flows through one or more grooves 124 as shown by flow path 145. Fluid flowing through grooves 124 then flows into passageway 128. By allowing fluid in these spaces to vent or flow out the bottom of upper sub 102 via grooves 124 into passageway 128, enables upper sub 102 and lower sub 104 to be coupled or screwed together without having issues relating to hydraulic locking.

Any of gaps 140, 142 may be formed by forming or removing a portion of one or both sides of one or more threads 118 and/or threads 132. In one aspect, $D_1$ of gaps 140, 142 may be from about 0.10 inch to about 0.01 inch. In one aspect, $D_1$ of gaps 140, 142 may be from about 0.06 inch to about 0.02 inch. In yet another aspect, $D_1$ of gaps 140, 142 may be approximately 0.04 inch.

Grooves 124 are preferably formed in non-threaded section 120 and extend from just below seal 123 to tapered end 122 to provide flow path 145 for fluid to enter passageway 128. Grooves 124 may be substantially longitudinal recesses. Upper sub 102 and lower sub 104 may be a tubular or tubular member having a substantially cylindrical body with a central passageway therethrough. Stress relief sections 112, 134 may be circumferential recessed portions formed in partially or fully the entire circumference of the outer diameter of stress relief sections 112, 134 by any means commonly known to those skilled in the arts. Stress relief sections 112, 134 may extend partially or fully the entire length ($L_2$) and length ($L_3$) of stress relief sections 112, 134, respectively.

Tubulars and/or tubular members as herein discussed may mean a term pertaining to any type of oilfield pipe, such as drill pipe, drill collars, pup joint, casing, production tubing, coiled tubing, mandrels, etc.

Seals 114, 123 may consist of any suitable sealing element or elements, such as a single O-ring, a plurality of O-rings, and/or a combination of backup rings, O-rings, and the like. In various embodiments, Seals 114, 123 may comprise AFLAS®, o-rings with PEEK back-ups for severe downhole environments, Viton O-rings for low temperature service, Nitrile or Hydrogenated Nitrile O-rings for high pressure and temperature service, or a combination thereof.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A downhole safety joint for use in a wellbore, comprising:

an upper tubular member having an upper threaded end having a first number of threads per inch and a lower external threaded section having a second number of threads per inch;

a lower tubular member having a lower threaded end having the first number of threads per inch and an upper interior threaded section having the second number of threads per inch for engaging with the lower external threaded section to form a break joint, the first number of threads per inch being greater than the second number of threads per inch, the break joint having one or more of a maximum compressive stress limit and a tensile stress limit;

one or more circumferential recessed areas disposed into an outer diameter of the upper tubular member between the upper threaded end and the lower external threaded section; and one or more circumferential recessed areas disposed into an outer diameter of the lower tubular member between the lower threaded end and the upper interior threaded section, wherein the one or more circumferential recessed areas of the upper tubular member and the lower tubular member transmit a side load applied to the break joint to one or more of the circumferential recessed areas of the upper tubular member and the lower tubular member less than one or more of the maximum compressive stress limit and the tensile stress limit.

2. The downhole safety joint as recited in claim 1 wherein the one or more circumferential recessed areas of the upper tubular member and the lower tubular member have an outer diameter less than at least one of the upper tubular member and the lower tubular member.

3. The downhole safety joint as recited in claim 1 wherein the one or more circumferential recessed areas of the upper tubular member and the lower tubular member flex or bend to transmit the side load exceeding one or more of the maximum compressive stress limit and tensile stress limit to the one or more circumferential stress reliefs.

4. The downhole safety joint as recited in claim 1 wherein the one or more circumferential stress reliefs flex or bend to transmit 90 percent of the side load exceeding one or more of the maximum compressive stress limit and tensile stress limit to the one or more circumferential stress reliefs.

5. A downhole safety joint for use in a wellbore, comprising:

an upper tubular member having an upper threaded end and a lower section having a plurality of external threads, the lower section having a non-threaded section below the lower threaded section;

a lower tubular member having a lower threaded end and an upper end having a plurality of internal threads for engaging with the plurality of external threads to form a break joint, the break joint having one or more of a maximum compressive stress limit and a tensile stress limit;

one or more circumferential stress reliefs disposed into the outer diameter of at least one of the upper tubular member and lower tubular member for transmitting a side load applied to the break joint to one or more of the circumferential stress reliefs less than one or more of the maximum compressive stress limit and the tensile stress limit;

a channel formed by gaps between the plurality of joined external and internal threads for transmitting a fluid the external and internal threads; and a longitudinal groove disposed in the outer diameter of the non-threaded section to provide a fluid pathway to a central passageway of the downhole safety joint.

6. The downhole safety joint as recited in claim 5 wherein the one or more circumferential stress reliefs are circumferential recessed areas in the outer diameter of the one of the upper tubular member and the lower tubular member.

7. The downhole safety joint as recited in claim 5 wherein the one or more circumferential stress reliefs is a circumferential recessed area disposed between the upper threaded end and the lower external threaded section of the upper tubular member.

8. The downhole safety joint as recited in claim 5 wherein the one or more circumferential stress reliefs is a circumferential recessed area disposed between the lower threaded end and the upper internal threaded section of the upper tubular member.

9. The downhole safety joint as recited in claim 5 wherein the one or more circumferential stress reliefs have an outer diameter less than at least one of the upper tubular member and the lower tubular member.

10. The downhole safety joint as recited in claim 5 wherein the gaps are formed by the plurality of internal threads have a width less than the width of the corresponding plurality of external threads.

11. The downhole safety joint as recited in claim 5 wherein the one or more circumferential stress reliefs flex to transmit less than the maximum tensile stress limit of the applied tensile stress to the break joint.

12. The downhole safety joint as recited in claim 5 wherein the gaps are from about 0.06 inch to about 0.04 inch.

13. The downhole safety joint as recited in claim 5 wherein the one or more circumferential stress reliefs flex or bend to transmit the side load exceeding one or more of the maximum compressive stress limit and tensile stress limit to the one or more circumferential stress reliefs.

14. The downhole safety joint as recited in claim 5 wherein the one or more circumferential stress reliefs flex or bend to transmit 90 percent of the side load exceeding one or more of the maximum compressive stress limit and tensile stress limit to the one or more circumferential stress reliefs.

* * * * *